United States Patent [19]

Messenger

[11] 4,368,787

[45] Jan. 18, 1983

[54] ARRANGEMENT FOR REMOVING BOREHOLE CUTTINGS BY REVERSE CIRCULATION WITH A DOWNHOLE BIT-POWERED PUMP

[75] Inventor: Joseph U. Messenger, Dallas, Tex.

[73] Assignee: Mobil Oil Corporation, New York, N.Y.

[21] Appl. No.: 211,871

[22] Filed: Dec. 1, 1980

[51] Int. Cl.[3] ..... E21B 7/04; E21B 7/16; E21B 7/18; E21B 10/08

[52] U.S. Cl. ..... 175/319; 175/65; 175/324

[58] Field of Search ..... 175/65, 67, 213, 319, 175/324

[56] References Cited

U.S. PATENT DOCUMENTS 2,174,102 9/1939 Catland ..... 175/229
3,416,618 12/1968 Kunnemann ..... 175/213

FOREIGN PATENT DOCUMENTS 604959 4/1978 U.S.S.R. ..... 175/319

*Primary Examiner*—Stephen J. Novosad
*Assistant Examiner*—Joseph Falk
*Attorney, Agent, or Firm*—Charles A. Huggett; Michael G. Gilman; James F. Powers, Jr.

[57] ABSTRACT

An arrangement for drilling deviated wellbores, such as in extended reach drilling, which is particularly designed to reduce the chance of pressure-differential sticking of the drill string by removing the drilling cuttings from the wellbore bottom by reverse circulation of the drilling fluid using a pump powered by the cones of the rotary bit. The drill string is turned by a rotary, and as the drill string turns, the cones turn as they are rolled on the bottom of the hole. A power drive is taken off the bit cones, and powers a pump which pumps mud from the annulus, around and through the bit, and up the drill pipe. In this way, troublesome cuttings are kept out of the annulus, and the cuttings are more effectively removed by pumping up and out the drill pipe.

4 Claims, 3 Drawing Figures

ARRANGEMENT FOR REMOVING BOREHOLE CUTTINGS BY REVERSE CIRCULATION WITH A DOWNHOLE BIT-POWERED PUMP

BACKGROUND OF THE INVENTION

1. Field of the Invention

The present invention relates generally to a rotary drilling arrangement for mitigating pressure-differential sticking of a drill string in a wellbore. More particularly, the subject invention concerns a method and apparatus for drilling deviated well bores, such as in extended reach drilling, which are particularly designed to reduce the chance of pressure-differential sticking of the drill string by pumping the drilling cuttings from the wellbore bottom by reverse circulation using a pump powered by the cones of the rotary bit.

Extended Reach Drilling is concerned with rotary drilling procedures to drill, log and complete wellbores at significantly greater inclinations and/or over horizontal distances substantially greater than currently being achieved by conventional directional drilling practices. The success of extended reach drilling should benefit mainly offshore drilling projects as platform costs are a major factor in most offshore production operations. Extended reach drilling offers significant potential for (1) developing offshore reservoirs not otherwise considered to be economical, (2) taping sections of reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle extended reach directional drilling. In greater particulrity, hole inclinations of 60° or greater, combined with long sections of hole or complex wellbore profiles present significant problems which need to be overcome in extended reach drilling. The force of gravity, coefficients of friction, and mud particle settling are the major physical phenomena of concern.

As inclination increases, the available weight from gravity to move the pipe or wireline string down the hole decreases as the cosine of the inclination angle, and the weight lying against the low side of the hole increases as the sine of the inclination angle. The force resisting the movement of the drill string is the product of the apparent coefficient of friction and the sum of the forces pressing the string against the wall. At an apparent coefficient of friction of approximately 0.58 for a common water base mud, drill strings tend to slide into the hole at inclination angles up to approximately 60°. At higher inclination angles, the drill strings will now lower from the force of gravity alone, and must be mechanically pushed or pulled, or alternatively the coefficient of friction can be reduced. Since logging wirelines cannot be pushed, conventional wireline logging is one of the first functions to encounter difficulties in this type of operation.

Hole cleaning also becomes a more significant problem in high angle bore holes because particles need fall only a few inches to be out of the mud flow stream and to come to rest on the low side of the hole, usually in a flow-shaded area alongside the pipe. This problem is also encountered in substantially vertical wellbores but the problem is much worse in deviated wellbores. In deviated wellbores the drill string tends to lie on the lower side of the wellbore and drill cuttings tend to settle and accumulate along the lower side of the wellbore about the drill string. This condition of having drill cuttings lying along the lower side of the wellbore about the drill string along with the usual filter cake on the wellbore wall presents conditions susceptible for differential sticking of the drill pipe when a porous formation is penetrated that has internal pressures less than the pressures existing in the borehole.

Cuttings generated by rock bits are usually less than ½" in size and are usually plate-like in structure. A second source of cuttings, which are not really cuttings from the bit, are those generated by sloughing or by erosion of the borehole wall, and these are frequently 1" to 1½" in length and thicker than a drilled cutting. In general, the larger the cutting size, the more difficult it is to transport it in the mud stream. In mitigation of this, it should be pointed out that some regrinding of the cuttings normally takes place in all rotary-drilled holes by the drill string, particularly the drill collars, by crushing between the rotating pipe and the wall of the hole.

This settling of cuttings is particularly significant in the near horizontal holes expected to be drilled in extended reach drilling. Present drill strings of drill pipe body, tool joints and drill collars are usually round and rotate concentrically about a common axis. If the pipe rotates concentrically around the same axis as the tool joints which are normally positioned against the solid wall and act as bearings for the rotating string, then a long "keyseat" is developed as the pipe is buried and beds itself into the cuttings and wall cake. A similar action of a drill string rotating about a concentric axis in a thick wall cake in a vertical hole could produce the same results. If differential pressure (borehole mud pressure less formation pore pressure) exists opposite a permeable zone in the formation, then conditions are set for the pipe to become differentially wall stuck. In both cases, the pipe is partially buried and bedded into a mass of solids, and can be hydraulically sealed to such an extent that there is a substantial pressure difference in the interface of the pipe and the wall and the space in the open borehole. This hydraulic seal provides an area on the pipe for the pressure differential to force the pipe hard against the wall. The frictional resistance to movement of the pipe against the wall causes the pipe to become immovable, and the pipe is in a state which is commonly referred to as differentially stuck.

2. Discussion of the Prior Art

Pressure-differential sticking of a drill pipe is also discussed in a paper entitled "Pressure-Differential Sticking of Drill Pipe and How It Can Be Avoided or Relieved" by W. E. Helmick and A. J. Longley, presented at the Spring Meeting of the Pacific Coast District, Division of Production, Los Angeles, Calif., in May 1957. This paper states that the theory of pressure-differential sticking was first suggested when it was noted that spotting of oil would free pipe that had stuck while remaining motionless opposite a permeable bed. This was particularly noticeable in a field wherein a depleted zone at 4300 feet with a pressure gradient of 0.035 psi per foot was penetrated by directional holes with mud having hydrostatic gradients of 0.52 psi per foot. In view thereof, it was concluded that the drill collars lay against the filter cake on the low side of the hole, and that the pressure differential acted against the area of the pipe in contact with the isolated cake with sufficient force that a direct pull could not effect release. This paper notes that methods of effecting the release of such a pipe include the use of spotting oil to wet the pipe, thereby relieving the differential pressure, or the step of washing with water to lower the pressure differential by reducing the hydrostatic head. Field application of the principles found in a study discussed in this paper demonstrate that the best manner for dealing with differential sticking is to prevent it by the use of drill collar stabilizers or, more importantly, by intentionally shortening the intervals of time when pipe is at rest opposite permeable formations.

Drilling fluid or mud used in rotary drilling of wellbores is usually a mixture of water, clay, weighting material, and a few chemicals. Sometimes oil may be used instead of water, or a little oil is added to the water to give the mud certain desirable properties. Drilling mud serves several very important functions including the following. Mud is used to raise the cuttings made by the bit and lift them to the surface for disposal. Equally important, the mud also provides a means for keeping underground pressures in check. Since a hole full of drilling mud exerts pressure, the mud pressure can be used to contain pressure in a formation. Clay is frequently added to the mud so that it can keep the bit cuttings in suspension as they move up the hole. The clay also sheaths the wall of the hole. This thin veneer of clay is termed wall cake, and makes the hole stable so it will not cave in or slough.

The equipment in a typical drilling fluid circulating system consists of a large number of components. A mud pump takes in mud from the mud pits and sends it out a discharge line to a standpipe. The standpipe is a steel pipe mounted vertically on one leg of the mast or derrick. The mud is pumped up the standpipe and into a flexible, very strong, reinforced rubber hose called the rotary hose, or kelly hose. The rotary hose is connected to the swivel. The mud enters the swivel, flows down the kelly, drill pipe, and drill collars, and exists at the bit. It then flows with a sharp U-turn and heads back up the hole in the annulus which is the space between the outside of the drill string and wall of the hole.

Finally, the mud leaves the hole through a steel pipe called the mud-return line and falls over a vibrating, screenlike device called the shale shaker. The shaker screens out the cuttings and dumps them into one of the reserve pits (the earthen pits excavated when the site was being prepared). Accordingly the circulating system is essentially a closed loop system. The mud is circulated over and over again throughout the drilling of the well.

However, the prior art has also recognized that there may exist special circumstances under which a reverse circulation of drilling fluid is desirable, and in which the fluid flows in a reverse manner to that described above, namely down the annulus and up the drill string. The following U.S. patents disclose an approach of that nature, Henderson U.S. Pat. No. Re. 26,669, Wells U.S. Pat. No. 2,786,652, Failing U.S. Pat. No. 2,849,213, Baud et al. U.S. Pat. No. 3,012,621, Schumacher, Jr. U.S. Pat. No. 3,292,719, Elenburg U.S. Pat. No. 3,416,617, Kunnemann U.S. Pat. No. 3,416,618, Elenburg U.S. Pat. No. 3,419,092, Cobbs et al. U.S. Pat. No. 3,958,650, Young U.S. Pat. No. 3,958,651, and Wallers U.S. Pat. No. 4,055,224.

Moreover, a further area of the prior art is somewhat related to the present invention by their disclosures on drilling fluid pumps powered by the rotating roller cones of a drill bit, and these include Evans et al. U.S. Pat. No. 1,572,274, Sloan U.S. Pat. No. 1,656,798, Krall U.S. Pat. No. 2,056,471, Reynolds U.S. Pat. No. 2,646,128, Haines U.S. Pat. No. 3,384,179 and Vida et al. U.S. Pat. No. 3,736,994.

However, none of the prior art discussed and cited above is concerned with mitigating differential sticking of a drill string in a highly deviated wellbore by pumping the drilling cuttings from the wellbore bottom by reverse circulating drilling fluid with a pump which is mechanically driven by the rotating roller cones of the drill bit.

SUMMARY OF THE INVENTION

Accordingly an object of the present invention is to substantially extend the range of directionally drilled wells in what is now termed extended reach drilling. The present invention alleviates the problem of differential sticking of a drill string in a borehole in drilling of this nature by removing the cuttings from the wellbore bottom by reverse circulating drilling fluid with a pump which is mechanically driven by the rotating roller cones of the drill bit. With this arrangement, troublesome cuttings are kept out of the annulus, and the cuttings are more easily removed by pumping up and out the drill string.

Accordingly, a further object of the subject invention is to provide an improved method and arrangement for rotary drilling a wellbore into the earth in a manner which is designed to mitigate differential sticking of the drill string. Differential sticking of the drill string in the hole is mitigated by pumping the drilling cuttings from the wellbore bottom by reverse circulating drilling fluid down the annulus surrounding the drill string and up the center of the string by at least one pump which is mechanically driven by the rotating roller cones of the drill bit. The present invention is particularly applicable to extended reach drilling wherein the drilled hole has an inclination from a vertical of at least 60°. In preferred embodiment, the pump is mounted in a drill collar located above the drill bit, and includes three separate piston operated pumps driven by three roller cones of the drill bit.

BRIEF DESCRIPTION OF THE DRAWINGS

The foregoing and other objects and advantages of the inventive arrangement for removing borehole cuttings by reverse circulation with a downhole bit powered pump may be more readily understood by one skilled in the art, having reference to the following detailed description of several preferred embodiments thereof, taken in conjunction with the accompanying drawings wherein identical reference numerals refer to like elements throughout the several views, and in which.

DETAILED DESCRIPTION OF THE DRAWINGS

Figure 1:
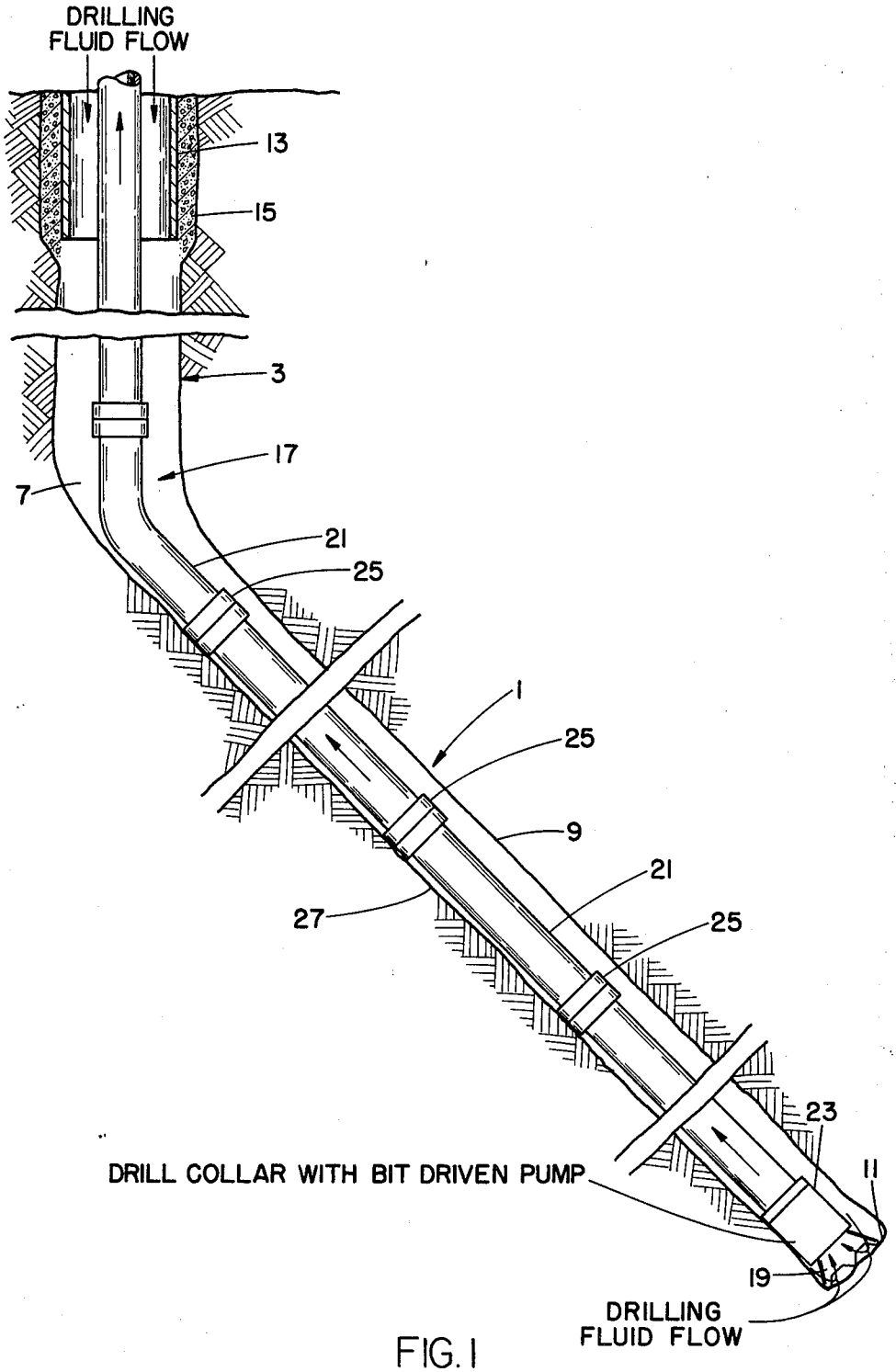
FIG. 1 is a drawing of a deviated wellbore extending into the earth and illustrates a schematic embodiment of the present invention.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, a drill pipe is always in tension during drilling operations. Drill pipe commonly varies from 3½" to 5" in outside diameter, and is normally constructed of steel. However, aluminum drill pipe is also available commercially, and may be an attractive option for extended reach drilling as it would reduce the weight of the drill string against the side of a high angle hole.

Commercially available 4½ inch aluminum drill pipe with steel tool joints should exert only about one third of the wall force due to gravity on the low side of an inclined hole in a 14 ppg mud as a similar steel drill string. Theoretically, for frictional forces, one third the wall force would then produce one third the drag and one third the torque of a comparable steel pipe string. Moreover, a commercial aluminum drill string compares favorably with a steel drill string regarding other physical properties.

Drill collars are thick walled pipe compared to drill pipe, and thus are heavier per linear foot than drill pipe. Drill collars act as stiff members in the drill string, and are normally installed in the drill string immediately above the bit and serve to supply weight on the bit. In common rotary drilling techniques, only the bottom three-fourths of the drill collars are in axial compression to load the bit during drilling, while about the top one-fourth of the drill collars are in tension, as is the drill pipe. The drill collars used in conducting rotary drilling techniques are of larger diameter than the drill pipe in use, and normally are within the range of 4½" to 10" in outside diameter.

Tool joints are connectors for interconnecting joints of drill pipe, and are separate components that are attached to the drill pipe after its manufacture. A tool joint is comprised of a male half or pin end that is fastened to one end of an individual piece of pipe and a female half or box end that is fastened to the other end. Generally, the box-end half of a tool joint is somewhat longer than the pin-end half. A complete tool joint is thus formed upon interconnecting together a box-end half and a pin-end half of a tool joint.

In carrying out rotary drilling techniques, a drilling rig is employed which utilizes a rotary table for applying torque to the top of the drill string to rotate the drill string and the bit. The rotary drill table also acts as a base stand on which all tubular members, such as drill pipe, drill collars, and casing, are suspended in the hole from the rig floor. A kelly is used as a top tubular member in the drill string, and the kelly passes through the rotary table and is acted upon by the rotary table to apply torque through the drill string to the bit.

As previously mentioned, in the drilling of well-bores utilizing rotary drilling equipment, problems known as differential sticking of the drill string are sometimes encountered. These problems become more severe in drilling deviated wellbores, particularly in extended reach drilling, inasmuch as the drill string lies on the bottom of the deviated portion of the wellbore and drill cuttings tend to settle about the drill string. Because the drill string and cuttings lay along the bottom of the deviated portion of the wellbore, that portion of the annulus that lies about the drill string serves as the main stream for the flow of the drilling mud and cuttings to the surface of the earth.

Referring to the drawings in detail, particularly with reference to FIG. 1, a deviated wellbore 1 has a vertical first portion 3 which extends from the surface 5 of the earth to a kick-off point 7 and a deviated second portion 9 of the wellbore which extends from the kick-off point 7 to the well-bore bottom 11. Although the illustrated embodiment shows a wellbore having a first vertical section extending to a kick-off point, the teachings of the present invention are applicable to other types of wellbores as well. For instance, under certain types of drilling conditions involving porous formations and large pressure differentials, the teachings herein may be applicable to vertical wellbores. Also, some deviated wellbores need not have the first vertical section illustrated in FIG. 1.

A shallow or surface casing string 13 is shown in the wellbore surrounded by a cement sheath 15. A drill string 17, having a drill bit 19 at the lower end thereof, is positioned in the wellbore 1. The drill string 17 is comprised of drill pipe 21 and the drill bit 19, and will normally include at least one drill collar 23. The drill pipe 21 is comprised of joints of pipe that are interconnected together by tool joints 25, and the drill string may also include wear knots for their normal function. In the deviated second portion 9, the drill string normally rests on the lower side 27 of the wellbore.

In accordance with the teachings of the present invention the cuttings are removed from the wellbore bottom 11 by reverse circulating drilling fluid, as shown by the arrows, with a pump in the drill collar 23 which is mechanically driven by the rotating roller cones of the drill bit 19. With this arrangement, troublesome cuttings are kept out of the annulus, and the cuttings are more easily removed by pumping up and out the drill string.

Figure 2:
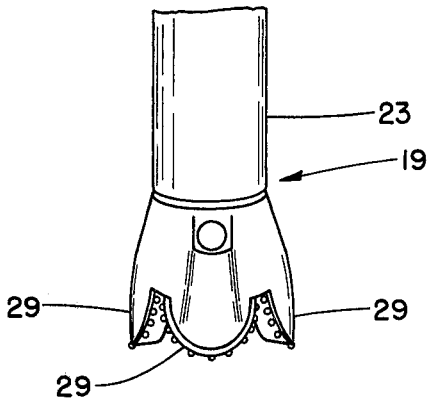
FIG. 2 is a perspective view of a typical rotary drilling bit.

FIG. 2 illustrates a typical rotary drilling bit 23 which has cone-shaped steel devices 29 called cones that are free to rotate as the bit rotates. Most roller-cone bits have three cones, although some have two and some have four. Bit manufacturers normally either cut teeth out of the cones or insert very hard tungsten carbide buttons into the cones. The teeth are responsible for actually cutting or gouging out the formation as the bit is rotated. The bit further has passages therein to allow drilling fluid to pass therethrough.

Figure 3:
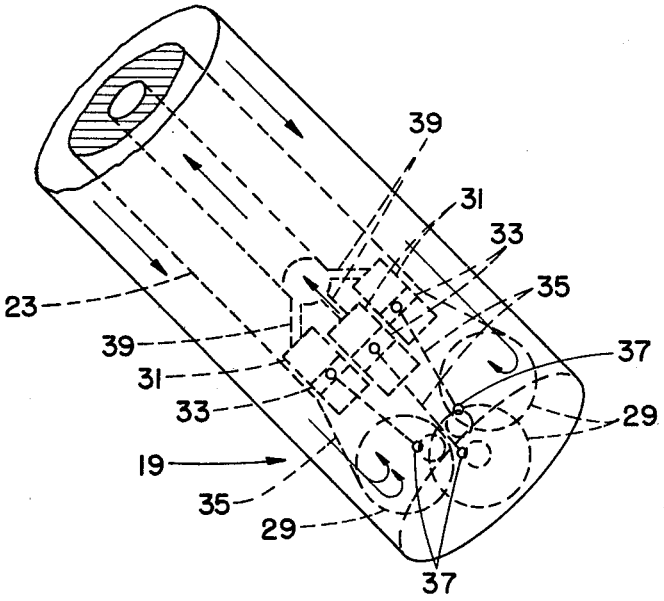
FIG. 3 illustrates details of one embodiment of a downhole piston operated pump driven by the rotating roller cones of a rotary drill bit.

FIG. 3 is an illustration of one embodiment of a drill collar 23 having therein a piston operated pump driven by the rotating roller cones 29 of a rotary drill bit. In this arrangement three piston pumps 31 having pistons 33 therein are positioned in the steel body of the drill collar. Each piston is connected by a rod linkage 35 to a rotating portion or pin 37 of the roller cones such that rotation of the roller cones results in a reciprocating movement of each piston 33 in its pump 31 to cause pumping of the drilling fluid. The pumps operate in a standard manner, similar to the operation of a steam engine, and pump mud having the cuttings entrained therein from the wellbore bottom 11, through passageways 39 into the center of the drill string and then up to the surface of the drilling operation.

Calculations have indicated that a 45 to 100 HP pump should be sufficient in most instances, operating to pump 700 gallons per minute, although flow rates as low as 40 to 60 gallons per minute should also be sufficient.

While several embodiments of the present invention have been described in detail herein, it should be apparent to one of ordinary skill in the rotary drilling arts that the present disclosure and teachings will suggest many other embodiments and variations to the skilled artisan. For instance, the pumps may be any suitable type of pump construction adequate for the purposes disclosed herein.

What is claimed is:

1. Apparatus for rotary drilling a wellbore into the earth designed to mitigate differential sticking of the drill string, comprising, a drill string having sections of drill pipe connected together and a drill bit with rotating roller cones at the lower end thereof, and means for mitigating differential sticking of the drill string in the wellbore including means for removing cuttings generated during the drilling operation by reverse circulating drilling fluid down the annulus surrounding the drill string and up the center of the string by at least one piston operated pump which is driven by a rod linkage to a rotating portion of one of said roller cones.

2. Apparatus for rotary drilling a wellbore as claimed in claim 1 in extended reach drilling, said drill string having at least one section having an inclination of at least 60°.

3. Apparatus for rotary drilling a wellbore as claimed in claim 2, wherein said pump is mounted in a drill collar located above said drill bit.

4. Apparatus for rotary drilling a wellbore as claimed in claim 1 or 2 or 3, wherein said at least one pump includes three piston operated pumps each driven by a respective rod linkage to one of three roller cones.

* * * * *